US005366088A

United States Patent [19]

Hill et al.

[11] Patent Number: 5,366,088

[45] Date of Patent: Nov. 22, 1994

[54] STACKABLE PIPETTE TIP RACK

[75] Inventors: Bob Hill, Novato; Tom Moulton, San Anselmo, both of Calif.

[73] Assignee: Larcon, North America, San Rafael, Calif.

[21] Appl. No.: 115,467

[22] Filed: Sep. 1, 1993

[51] Int. Cl.[5] ..... B65D 21/02; B65D 6/04

[52] U.S. Cl. ..... 206/499; 206/443; 206/486; 206/509; 206/562

[58] Field of Search ..... 206/443, 486, 499, 501, 206/509, 511, 515, 518, 562, 563

[56] References Cited

U.S. PATENT DOCUMENTS

| | | | |
|---|---|---|---|
| D. 271,239 | 11/1983 | Lemieux et al. . | |
| 1,061,026 | 5/1913 | Thomas . | |
| 2,779,526 | 1/1957 | Vogt . | |
| 3,039,881 | 6/1962 | Shapiro . | |
| 3,356,462 | 12/1967 | Cooke et al. . | |
| 3,494,201 | 2/1970 | Roach . | |
| 3,578,158 | 5/1971 | Aylott | 206/509 |
| 3,853,217 | 12/1974 | Scordato et al. . | |
| 3,918,781 | 11/1975 | Paris | 206/509 X |
| 3,937,322 | 2/1976 | Cohen . | |
| 4,136,773 | 1/1979 | Booth . | |
| 4,349,109 | 9/1982 | Scordato et al. | 206/486 X |
| 5,057,282 | 10/1991 | Linder | 206/562 X |

FOREIGN PATENT DOCUMENTS

| | | |
|---|---|---|
| 1475924 | 2/1966 | France . |
| 1129884 | 1/1956 | Germany . |
| 0269367 | 10/1950 | Switzerland . |

*Primary Examiner*—Bryon P. Gehman

*Attorney, Agent, or Firm*—Phillips, Moore, Lempio & Finley

[57] ABSTRACT

A pipette tip rack system is disclosed that includes a plurality of tip racks that may be nested one upon the other with an integrally formed locking mechanism that locks each rack to the one immediately below it. A cover member is also included that acts as a cover for the top rack in the stack. This cover also utilizes the same locking mechanism. Also included is a bottom member that serves as a dust cover and uses the same locking mechanism to permit its fixture to the bottom rack. The whole system when lockingly fixed together forms a relatively secure unit so that if it is upset the tips will not spill out. Further, each element in the stack retains its sterile condition. Finally, the stack of racks may be combined with a box having a top that fits over the cover and a bottom that receives the bottom member and lowest rack. This box may be removed from the stack and assembled so that a single rack may be used remote of the stack.

13 Claims, 4 Drawing Sheets

PUSH
10
12
14
16
18
20
22
24
26
28
30
32
34
36
38
40
42
70
2

STACKABLE PIPETTE TIP RACK

This invention relates to the storage of pipette tips, and in particular, to a multiple rack structure for the storage of pipette tips.

BACKGROUND OF THE INVENTION

Pipette tips are small, conically shaped devices that are affixed to the end of a pipetter for use in laboratory analysis. The pipetter is a mechanical device that includes a pump-type action to draw fluid up into the pipette tip in a specified amount so that the fluid can be transferred to another receptacle for the test to take place.

In recent years, the use of pipette tips has grown explosively so that they are sold in packages, usually containing about 100 tips. In one particular version, they are sold with 96 tips to a rack. This has become a common factor as pipetters are now made to handle multiple pipette tips, usually eight or twelve at a time.

Pipette tips are used only once. As indicated above, they are used in great quantities. In light of the use, ordinarily with some kind of medical or biological testing, sterility is of paramount importance. Accordingly, the racks mentioned above come fully equipped with pipette tips that have been sterilized so that the laboratory technician need not go through any particular sterilization step prior to use.

In order to save space, the purveyors of pipette tips generally sell them in nested racks. Such racks are described in U.S. Pat. No. 3,853,217 dated Dec. 10, 1974, and issued to Scordato. Stacking or nesting racks of the type described in Scordato have more recently been replaced by covered racks as represented by the covered rack of U.S. Pat. No. Des. No. 271,239, issued Nov. 1, 1983 to Lemieux et al. The Lemieux type of covered rack is shown in a variant hinged-type box, again with the normal 96 tips to the rack, but with the lower half of the box being the skirt of the Lemieux type rack.

In both the Lemieux rack and the hinged-top box described above, the surface upon which the tips are placed is of necessity reinforced to handle the incumbent force of the pipetter as it is brought down into contact with eight tips at a time. Since the fit of the tip on the pipetter is a friction fit, the top surface of the rack must, of necessity, withstand the pressure imposed by the pipetter so that either all eight or all twelve tips can be picked up at one time.

The nested racks of the Scordato era did not have the reinforcement found in the more recent racks of the '239 reference or the hinged-top boxes. The drawbacks with the Lemieux-type racks and the hinged-top boxes were that they were not nestable in the sense of Scordato and therefore considerably more volume was taken up by these racks.

The problem with nesting racks is that they are easily overturned on the laboratory bench. Thus, if there is a stack of five racks containing upwards of 100 tips per rack, the technician may very well be in the position of having lost 500 pipette tips as the sterilization is lost if the racks are overturned and the tips fall on the bench or floor. While the tips may be reracked (generally by hand), they would still require at least sterilization and, at worst, cleaning and sterilization. Due to the relatively low cost of the racks, they are generally thrown away if sterilization is lost.

In short, the problem with the existing pipette tip racks is that the stand-alone rack takes up too much space in the sale of the rack, while the nesting racks are easily overturned, with the loss of the pipette tips.

Another problem with the existing nesting racks is that when the individual rack is taken off the pile, there is no readily available cover or bottom piece in the rack and contamination can enter into the rack itself.

Accordingly, this invention is for a stacking pipette tip rack that includes an interlock between racks so that a plurality of pipette tip racks can be stacked one atop another. Also included in the invention is a cover piece and a base piece, both of which are adapted to utilize the locking mechanism of the rack. Finally, a separate hinged-top box may be provided with the plurality of racks so that a technician using a small quantity of tips can have at his or her laboratory bench the convenience of the single rack with a cover and a base or alternatively, a hinged-top box. On the other hand, the user of a large quantity of tips may be provided a plurality of tip racks that include a cover and a base member and that are interlocked so that if the stack is overturned only the tips in the top rack are in jeopardy and then only if the top is not in place.

This structure overcomes the shortcomings of the existing pipette tip racks while retaining the conventional multiple tip arrangement in the racks configured to be utilized with the multiple pipetters.

SUMMARY OF THE INVENTION

In order to overcome the shortcomings of the prior art, this invention is a pipette tip rack formed to lockingly nest with a second pipette tip rack of the same construction. The pipette tip rack is for holding a plurality of conically shaped pipette tips in an upright position. The tip rack includes a top rectangular surface defining a plurality of holes, each hole having a diameter less than the largest outside diameter of a pipette tip. The rack is formed with four subtending walls affixed at the top surface to form a generally rectangular parallelepipedal shaped member. At least one of the four subtending walls defines a locking feature for releasably lockingly nesting the tip rack to a second rack.

DETAILED DESCRIPTION OF THE PREFERRED EMBODIMENT

Figures 1, 2, 3:
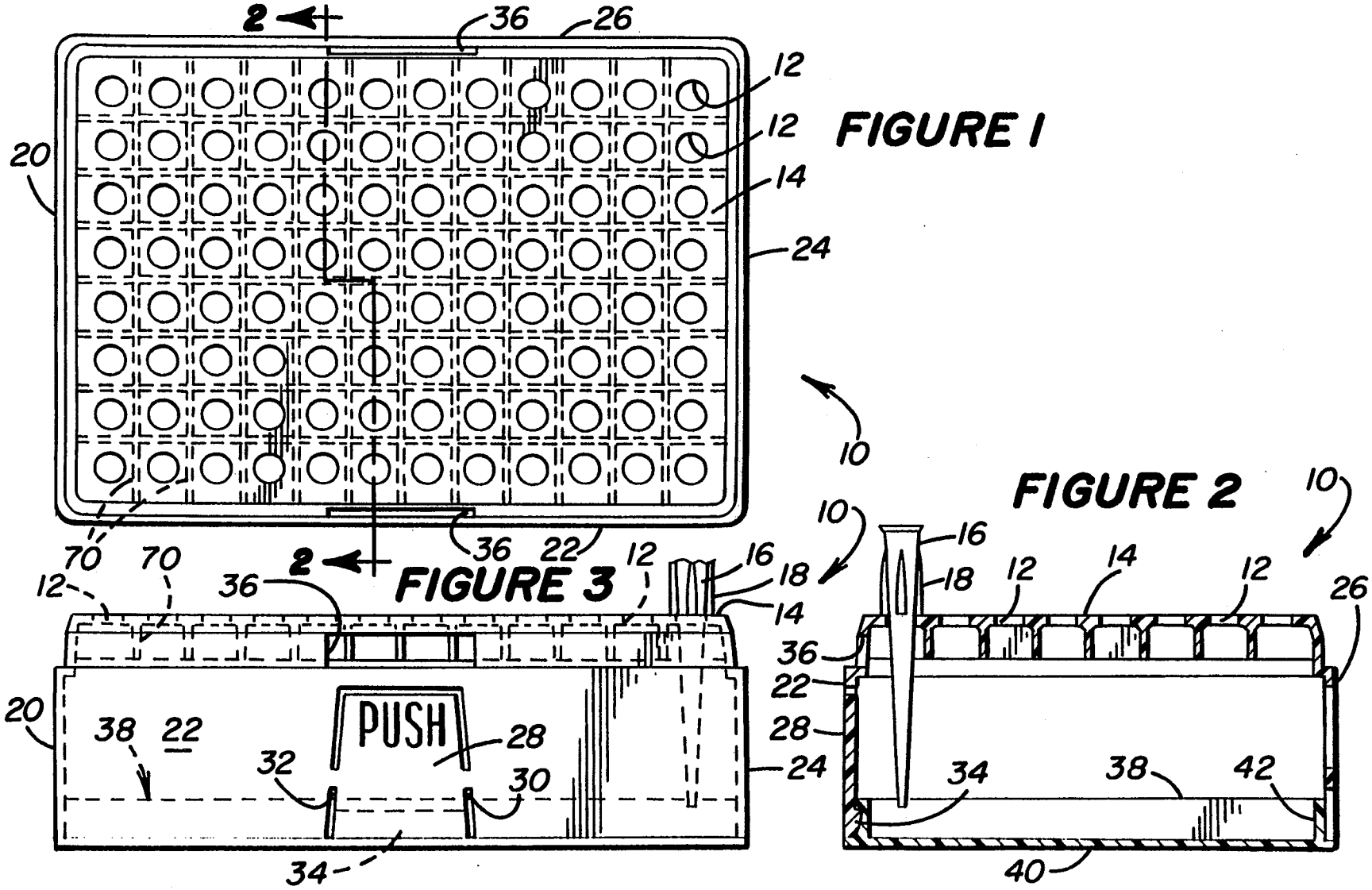
FIG. 1 is a top view of one of the plurality of pipette tip racks that is the subject of this invention.
FIG. 2 is a cross-sectional view of the rack shown in FIG. 1, shown at section line 2—2 thereof.
FIG. 3 is a side view of the rack shown in FIG. 1.

Referring now to FIGS. 1, 2 and 3, a pipette tip rack 10 manufactured in accord with the invention to be described herein is shown in plan view, side elevational view and front elevational view, respectively. Pipette tip rack 10 is constructed with a top rectangular surface 14 defining therein a plurality of holes 10. Each of the holes 12 is formed to receive a pipette tip 16, one of which is shown in FIG. 3. It can be seen in FIG. 3 that the pipette tip illustrated therein is conventional in its form, having a relatively long, conical shape with a number of protrusions 18 formed thereabout close to the large end of the conically shaped tip. The holes 12 are formed with a diameter sufficiently large to receive the conically shaped pipette tip, and so that the protrusions 18 will engage the top surface 14, thereby holding the tips in the rack. Other types of pipette tips could be easily positioned in the rack.

Figure 7:
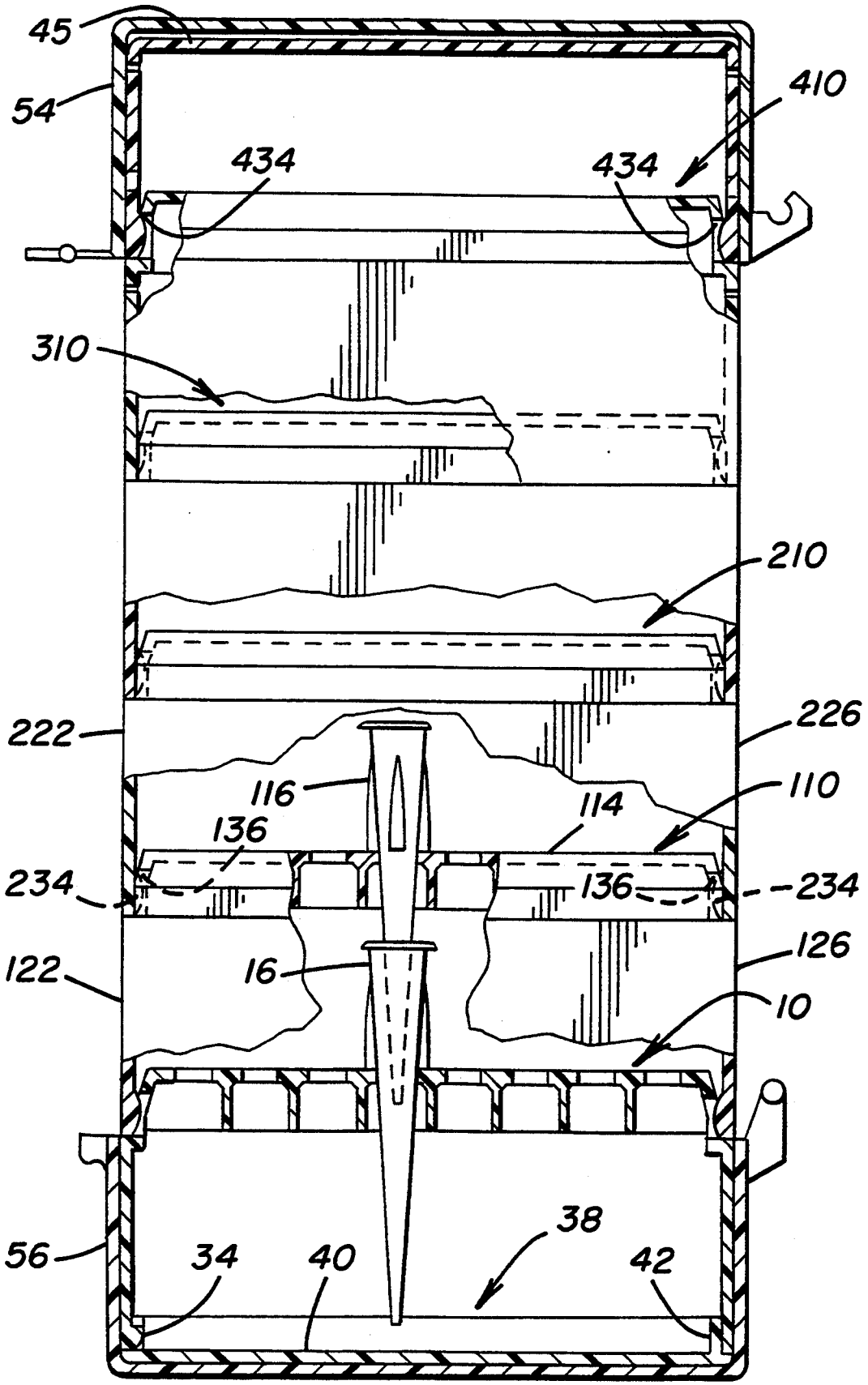
FIG. 7 is a view partly in section of a plurality of racks stacked one atop the other, showing the nesting feature of the racks and also including a cover member, a base member, and a hinged container for the racks.

Referring now to FIG. 7, the rack 10 is nested with a second rack 110, which contains a representative second pipette tip 116. As shown in FIG. 7, when the rack 110 is nested with the rack 10, the pipette tip 116 protrudes into the interior of the tip 16 in rack 10 so that there is a true nesting of the tips. This results in a considerable amount of saved space. This type of nesting is old in the art, and is shown in U.S. Pat. No. 3,853,217.

Pipette tip rack 10 includes four subtending walls 20, 22, 24 and 26, shown respectively in FIGS. 1, 2 and 3. The subtending walls form a generally rectangular, parallelepipedal shaped member.

In two of the sides, specifically side 22 and side 26 of the illustrated rack, a locking mechanism is included. This locking mechanism consists of a levered portion or pivotable member 28. Pivotable member 28 is affixed to side 22 by two hinging portions 30 and 32, making the member pivotable about an axis passing through the hinges 30 and 32. Along the lower portion of pivotable member 28 is an inwardly extending boss 34. By means of pressure on lever 28 adjacent the top surface 14, the boss 34 may be caused to move outwardly. This will become important in the ensuing discussion.

Formed adjacent to the top surface 14 and on the same sidewalls 22 and 26, are openings 36. These openings are formed to receive the boss 34 of the adjacent rack when nested. Referring now to FIG. 7, it can be seen that the boss 234, which is affixed to rack 210 or the third rack in the stack, is held in the opening 136 of the second rack 110. In like manner, the boss 234 on side 226 of rack 210 is affixed in the hole 136 of rack 110 on the side 126.

As can be seen in FIG. 7, a plurality of racks, five in FIG. 7, can be interconnected one to the other to make a stack of five racks. While racks have been stacked in the past, they have not been interconnected by means of structure associated with the rack itself. In one prior art rack, the racks were held together with tape, whereas in another, they were contained in a box.

Figure 4:
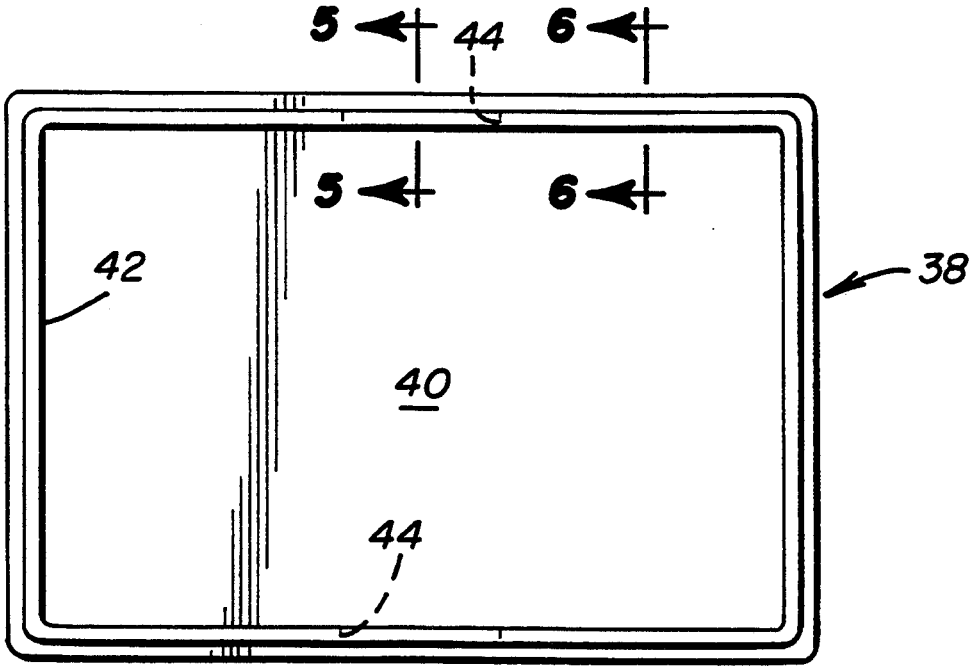
FIG. 4 is a plan view of the base member utilized with the rack shown in FIG. 1.

While the inventive locking structure just described is adequate for purposes of marketing stacks of five pipette tip racks, it does not solve the problem for retaining the sterility of a single pipette tip rack when it is removed to be used on the laboratory bench. Accordingly, reference is made to FIGS. 4, 12 and 13. In FIG. 4, a base member 38 is illustrated in plan view. This base member is shown in section in FIG. 2 installed in rack 10. The base member 38 has a flat enclosed bottom 40 and upstanding walls 42, thereby making a shallow rectangular parallelepipedal shape that is adapted to be inserted into the subtending sides or skirt of the pipette tip rack 10, as best illustrated in FIG. 3.

In order to retain the bottom piece 38 within the rack 14, openings 44 are formed in the upstanding walls of the bottom piece 38 so that the protrusions 34 on the pipette tip rack may engage these openings. Reference to FIG. 2 will show a bottom piece 38 engaged with pipette tip rack 10.

In like manner, a top piece 45 (see FIG. 12) is formed to cover the open pipette tip rack 10 when it is no longer in the rack configuration as shown in FIG. 7, or alternatively, the top member 45 can be used at the top of the stack (see FIG. 7) engaged with the uppermost pipette tip rack 410. Again, locking member 46 is formed so that it is pivotable about two connection or hinge points 48, which affix the locking member 46 to the remainder of top 45. It should be understood that the opposite side of top member 45 is formed identically with the side shown in FIG. 12. Locking member 46 includes a boss 50 at the lower end thereof, which can be engaged with the opening 434 as shown in FIG. 7 of the uppermost pipette tip rack 410.

Thus, in one configuration, a stack of pipette tip racks such as shown in FIG. 7 includes the base member 40 removably fixed to the lower-most pipette tip rack 10. Also included is the cover or top piece 45, which is affixed to the top pipette tip rack 410, thus forming a relatively contamination-free environment for the plurality of pipette tips stored in the racks. It should be noted that extra cover pieces 45 and bases 40 can be provided with a plurality of racks so that as individual laboratory technicians utilize a single rack, a cover and base may be associated with that rack to keep the pipettes in the rack dust-free on the laboratory bench.

Figure 12:
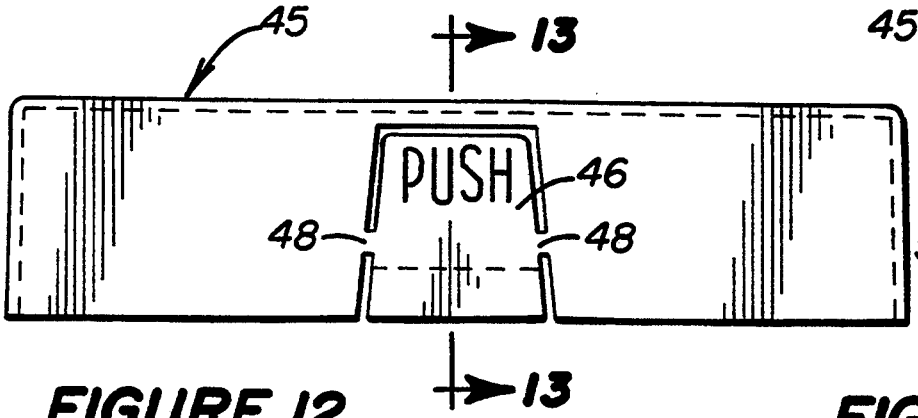
FIG. 12 is a front elevation view of a locking cover for the rack shown in FIG. 1.
Figure 13:
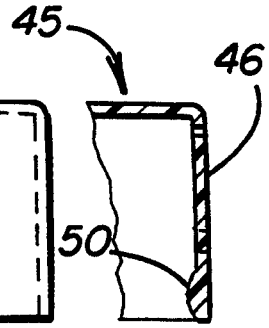
FIG. 13 is a partial view in section of the cover shown in FIG. 12 at line 13—13.
Figure 5:
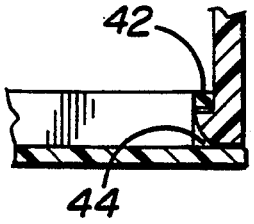
FIG. 5 is a cross-sectional view of the base member shown in FIG. 4 at line 5—5 thereof.
Figure 6:
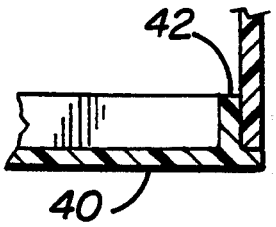
FIG. 6 is a cross-sectional view of the base member shown in FIG. 4 at line 6—6 thereof.
Figure 9:
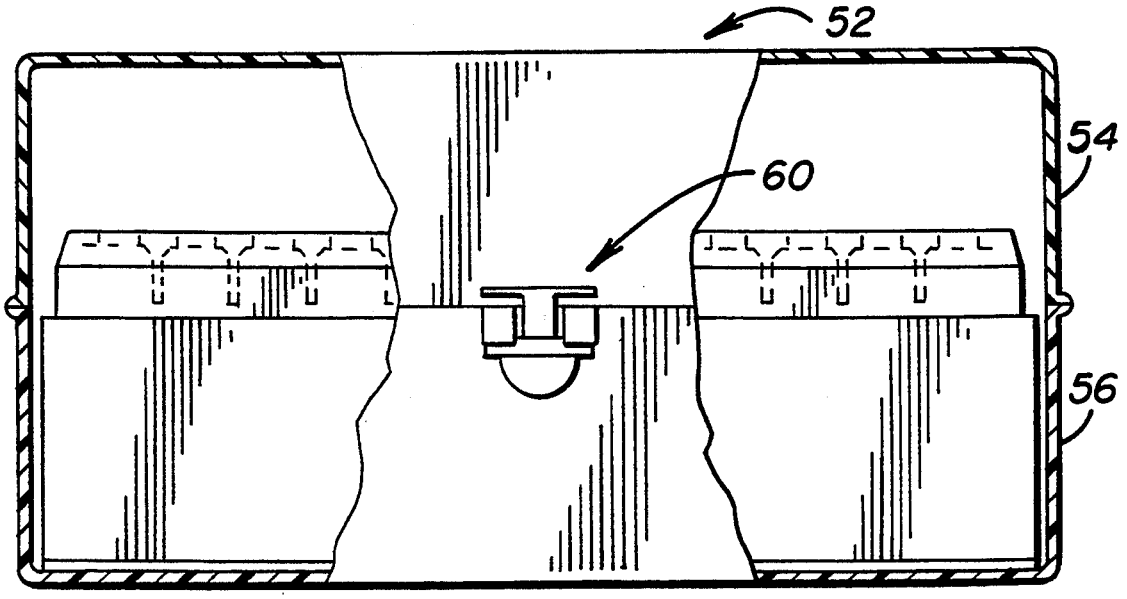
FIG. 9 is a front elevational view partly in section of the rack and hinged-top box shown in FIG. 8.
Figure 11:
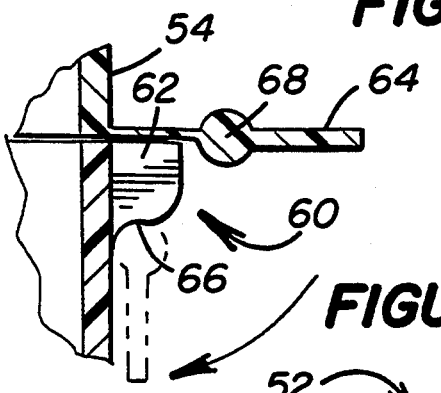
FIG. 11 is a side elevational view of the locking member shown in FIG. 10 at line 11—11.
Figure 10:
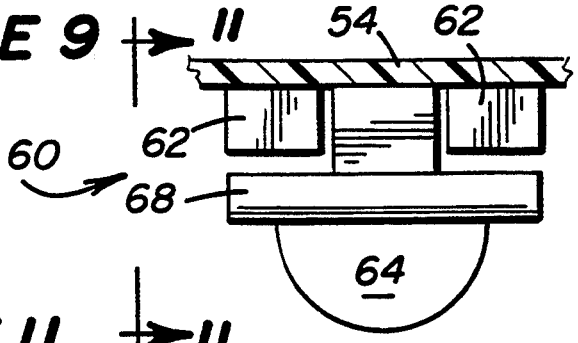
FIG. 10 is an elevational view of the locking member of the hinged top box.
Figure 8:
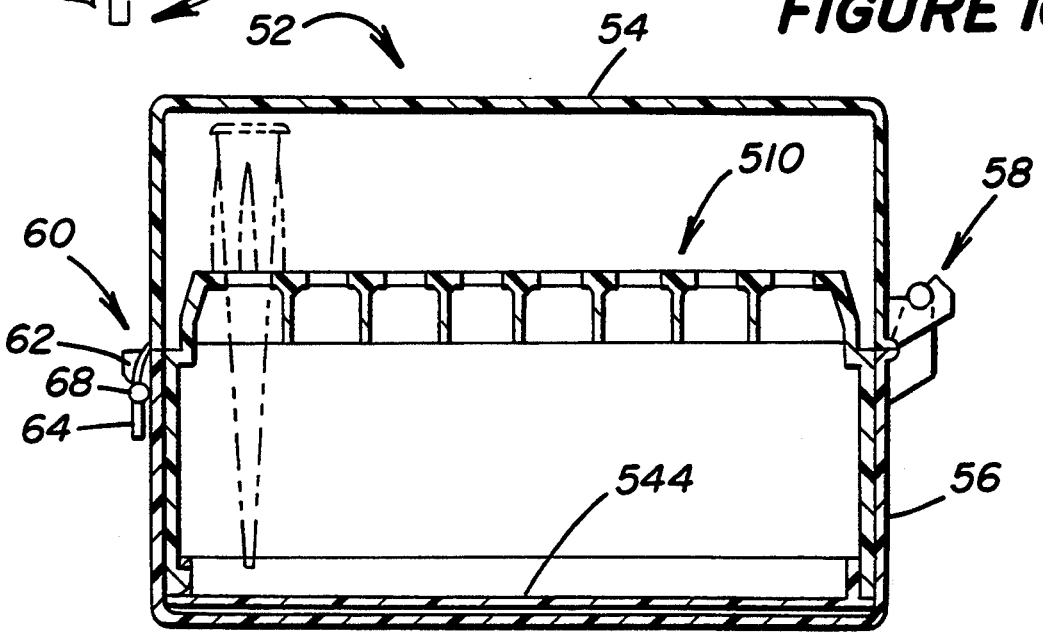
FIG. 8 is a sectional view of a pipette tip rack fixed in a hinged-top box, with an appropriate locking member.

In addition to the cover and top pieces shown in FIG. 7 and better illustrated in FIGS. 4, 12 and 13, the stack can include a box 52, best illustrated in FIGS. 8 and 9. This box 52 is formed to receive a single pipette tip rack 510, which may or may not be equipped with a base piece 544 and a top cover piece (not shown). (See, however, FIG. 7 wherein the locked rack includes both a box bottom 56 and a box top 54 in a disassembled state.) The box member 52 includes its own hinged cover 54 affixed to the base 56 by a pair of hinges 58 and a latch 60 on the opposite side thereof. The latch 60 and the hinges 58 are relatively conventional in design, except that they may be disengaged to separate the top and bottom. However, the latch 60 in this particular instance includes two latching members 62 integrally formed with the bottom 56 and a flexible-type tab member 64 affixed to the top member 54. When the flexible tab member is rotated downwardly, it engages in a notch 66 in the latching member 62 by means of a cylindrical portion 68. This arrangement is convenient for opening and closing without the necessity of using a great deal of force. Other latches can be appropriately formed.

Referring to FIG. 7, the stack can be sold in the form that a bottom member 56 is included along with a top member 54 in the stack. In this particular arrangement, the stack would not only include the plurality of racks 10, 110, 210, 310 and 410, but also the bottom 40 and the top cover piece 45, along with the box comprised of bottom member 56 and top member 54.

In use, the individual racks can be separated from the stack shown in FIG. 7 and taken to the laboratory bench either in the box, as illustrated in FIGS. 8 and 9, or with the top cover piece and bottom piece illustrated in FIGS. 4 and 12. The rack is particularly configured so that multiple pipette tips can be extracted from the rack using the modern-day pipetters, which may utilize eight or twelve tips at a time. Each rack is accordingly reinforced with a grid-like structure 70 (see FIGS. 1 and 3) supporting the upper surface or top rectangular surface 14. The grid-like structure results in a rigid top surface that does not deflect as the pipetters are forced onto the pipette tips in a manner well known in the art.

While this invention has been described with respect to a single embodiment, the invention is limited only so far as the appended claims limit the invention.

What is claimed is:

1. A pipette tip rack formed to lockingly nest with a second pipette tip rack of the same construction, the pipette tip rack for holding a plurality of conically shaped pipette tips in an upright position and comprising:

a top rectangular surface defining a plurality of holes, each hole having a diameter less than the largest outside diameter of a pipette tip;

four subtending walls affixed to said top surface thereby forming a generally rectangular parallelepipedal shaped member;

at least one of the four subtending walls defining locking means for releasably lockingly nesting said rack to a second rack;

said locking means comprising a first pivotable member integrally formed with one of the four subtending walls and pivotable about an axis substantially parallel to the top rectangular surface, said pivotable member defining an integrally extending boss along its lower edge distal from said top rectangular surface, so that said boss is movable outwardly of the plane of the subtending wall when the first pivotable member is pivoted.

2. The rack of claim 1 further defining an opening in the one of the four subtending walls, the opening forming a part of the locking means, said opening formed between the pivotable member in said one of the four subtending walls and said top rectangular surface.

3. The rack of claim 2 comprising a second pivotable member integrally formed in a second subtending wall opposite said first pivotable member, said second pivotable member pivotable about an axis substantially parallel to the pivot axis of said first pivotable member and defining an inwardly extending boss along its lower edge distal from said top rectangular surface;

said rack further defining an opening in said second subtending wall, the opening formed between said second pivotable member and said top rectangular surface.

4. The rack of claim 3 further comprising a cover member having an upper rectangular surface and four subtending walls, the four cover member subtending walls dimensioned so that they will nestingly fit on the shoulder inset of the rack, the inside height of the cover member combined with the height of a rack subtending wall being greater than the length of a pipette tip held in the rack;

at least one of the four cover member subtending walls formed with a first pivotable member integrally formed with the one of the four cover member subtending walls and pivotable about an axis substantially parallel to the cover member upper rectangular surface, said cover member first pivotable member defining an inwardly extending boss along its lower edge distal from the upper rectangular surface, said boss releasably lockingly engageable with the opening of the rack upon which it is nested.

5. The rack of claim 4 further comprising a base member, said base member having a lower rectangular surface of dimensions generally equal to the outside dimension of the parallelepiped formed by the four subtending walls of the rack;

said base member further comprising four upstanding walls formed to nestingly fit within the subtending walls of the rack;

at least one of said upstanding walls including an opening forming a part of the locking means whereby said base member may be lockingly affixed to said rack.

6. The rack of claim 2 wherein the subtending walls define a shoulder inset adjacent the top rectangular surface, said shoulder inset having a width at least equal to the thickness of the subtending wall at the edge distal of the top rectangular surface.

7. The rack of claim 6 in combination with a second pipette tip rack of substantially identical structure, said second rack nestable with the first rack so that the four subtending walls of said second rack will rest on the shoulder inset of the first rack and the inwardly extending boss of the second rack releasably lockingly engaging the opening in the first rack, said subtending walls of the first and second racks having a combined height greater than a pipette tip held in the first rack.

8. The rack combination of claim 7 comprising, in each rack, a second pivotable member integrally formed in a second subtending wall opposite said first pivotable member, said second pivotable member pivotable about an axis substantially parallel to the pivot axis of said first pivotable member and defining an inwardly extending boss along its lower edge distal from said top rectangular surface;

each rack further defining an opening in its said second subtending wall, the opening formed between said second pivotable member and said top rectangular surface.

9. The rack combination of claim 8 further comprising a cover member having an upper rectangular surface and four subtending walls, the four cover member subtending walls dimensioned so that they will nestingly fit on the shoulder inset of the second rack, the inside height of the cover member combined with the height of a second rack subtending wall being greater than the length of a pipette tip held in the second rack;

at least one of the four cover member subtending walls formed with a first pivotable member integrally formed with the one of the four cover member subtending walls and pivotable about an axis substantially parallel to the cover member upper rectangular surface, each cover member first pivotable member defining an inwardly extending boss along its lower edge distal from the upper rectangular surface, said boss releasably lockingly engageable with the opening of the second rack upon which it is nested.

10. The rack combination of claim 9 further comprising a base member, said base member having a lower rectangular surface of dimensions generally equal to the outside dimension of the parallelepiped formed by the four subtending walls of the first rack;

said base member further comprising four upstanding walls formed to nestingly fit within the subtending walls of the first rack;

at least one of said upstanding walls including an opening forming a part of the locking means whereby said base member may be lockingly affixed to said first rack.

11. The rack of claim 6 further comprising a cover member having an upper rectangular surface and four subtending walls, the four cover member subtending walls dimensioned so that they will nestingly fit on the shoulder inset of the rack, the inside height of the cover member combined with the height of a rack subtending wall being greater than the length of a pipette tip held in the rack;

at least one of the four cover member subtending walls formed with a first pivotable member integrally formed with the one of the four cover member subtending walls and pivotable about an axis substantially parallel to the cover member upper rectangular surface, said cover member first pivotable member defining an inwardly extending boss along its lower edge distal from the upper rectangular surface, said boss releasably lockingly engageable with the opening of the rack upon which it is nested.

12. The rack of claim 11 further comprising a base member, said base member having a lower rectangular surface of dimensions generally equal to the outside dimension of the parallelepiped formed by the four subtending walls of the rack;

said base member further comprising four upstanding walls formed to nestingly fit within the subtending walls of the rack;

at least one of said upstanding walls including an opening forming a part of the locking means whereby said base member may be lockingly affixed to said rack.

13. The rack of claim 12 in combination with a box member, said box member including a bottom and a top, said top removably hingedly fixable to said bottom; along one edge, said top and bottom further including latch means formed along the edge opposite to the one edge for latching the top and bottom members together whereby the rack, with its cover and its base member, may be placed in said bottom, and said top may be hingedly closed upon said rack.

* * * * *